US011238883B2

(12) United States Patent
Port et al.

(10) Patent No.: US 11,238,883 B2
(45) Date of Patent: Feb. 1, 2022

(54) DIALOGUE ENHANCEMENT BASED ON SYNTHESIZED SPEECH

(71) Applicant: Dolby Laboratories Licensing Corporation, San Francisco, CA (US)

(72) Inventors: Timothy Alan Port, Drummoyne (AU); Winston Chi Wai Ng, Sydney (AU); Mark William Gerrard, Balmain (AU)

(73) Assignee: Dolby Laboratories Licensing Corporation, San Francisco, CA (US)

( * ) Notice: Subject to any disclaimer, the term of this patent is extended or adjusted under 35 U.S.C. 154(b) by 136 days.

(21) Appl. No.: 16/420,891

(22) Filed: May 23, 2019

(65) Prior Publication Data

US 2019/0362732 A1 Nov. 28, 2019

Related U.S. Application Data

(60) Provisional application No. 62/676,368, filed on May 25, 2018.

(30) Foreign Application Priority Data

May 25, 2018 (EP) ..... 18174310

(51) Int. Cl.
*G10L 21/0364* (2013.01)
*G10L 13/033* (2013.01)
*G10L 13/08* (2013.01)

(52) U.S. Cl.
CPC ..... *G10L 21/0364* (2013.01); *G10L 13/033* (2013.01); *G10L 13/08* (2013.01)

(58) Field of Classification Search
CPC ... G10L 21/0364; G10L 13/033; G10L 13/08; G10L 21/003; G10L 13/00
See application file for complete search history.

(56) References Cited

U.S. PATENT DOCUMENTS

2007/0219791 A1* 9/2007 Gao ..... G10L 21/045 704/233
2008/0040116 A1 2/2008 Cronin
(Continued)

FOREIGN PATENT DOCUMENTS

FR 3040522 A1 * 3/2017 ..... G10L 21/0364
JP 3742206 B2 * 2/2006 ..... G10L 13/06
(Continued)

OTHER PUBLICATIONS

Le Magoarou, Luc, Alexey Ozerov, and Ngoc QK Duong. "Text-informed audio source separation. example-based approach using non-negative matrix partial co-factorization." Journal of Signal Processing Systems 79.2 (2015): 117-131. (Year: 2015).*
(Continued)

*Primary Examiner* — Jonathan C Kim

(57) ABSTRACT

A method and a system for dialogue enhancement of an audio signal, comprising receiving (step S1) the audio signal and a text content associated with dialogue occurring in the audio signal, generating (step S2) parameterized synthesized speech from the text content, and applying (step S3) dialogue enhancement to the audio signal based on the parameterized synthesized speech. With the invention text captions, subtitles, or other forms of text content included in an audio stream, can be used to significantly improve dialogue enhancement on the playback side.

20 Claims, 4 Drawing Sheets

(56) References Cited

U.S. PATENT DOCUMENTS

| | | | | |
|---|---|---|---|---|
| 2008/0249772 | A1* | 10/2008 | Martynovich | G10L 21/0364 704/233 |
| 2009/0037179 | A1* | 2/2009 | Liu | G10L 13/08 704/260 |
| 2009/0119096 | A1* | 5/2009 | Gerl | H04R 3/12 704/207 |
| 2010/0131276 | A1* | 5/2010 | Den Brinker | G10L 19/093 704/262 |
| 2014/0108020 | A1* | 4/2014 | Sharma | G10L 25/87 704/500 |
| 2015/0088522 | A1 | 3/2015 | Hendrickson | |
| 2015/0199977 | A1* | 7/2015 | Ungstrup | G10L 13/00 704/260 |
| 2015/0255083 | A1* | 9/2015 | Krini | G10L 13/00 704/226 |
| 2016/0064008 | A1* | 3/2016 | Graham | G10L 21/0208 704/227 |
| 2016/0125893 | A1 | 5/2016 | Magoarou | |
| 2016/0365087 | A1* | 12/2016 | Freud | G10L 13/10 |
| 2017/0047080 | A1* | 2/2017 | Shiga | G10L 21/0232 |
| 2017/0194009 | A1* | 7/2017 | Hatanaka | H04S 3/008 |
| 2017/0243582 | A1* | 8/2017 | Menezes | G10L 13/033 |
| 2018/0233127 | A1* | 8/2018 | Visser | G10L 15/26 |
| 2018/0366138 | A1* | 12/2018 | Ramprashad | G10L 21/0208 |
| 2021/0151082 | A1* | 5/2021 | Wang | G11B 27/034 |

FOREIGN PATENT DOCUMENTS

| | | |
|---|---|---|
| WO | 2014062688 | 4/2014 |
| WO | 2014094858 | 6/2014 |
| WO | 2014094859 | 6/2014 |

OTHER PUBLICATIONS

Kinoshita, Keisuke, et al. "Text-informed speech enhancement with deep neural networks." Sixteenth Annual Conference of the International Speech Communication Association. 2015. (Year: 2015).*

Dzibela, Daniel, entitled "Hidden-Markov-Model Based Speech Enhancement." at Faculty of Electrical Engineering and Information Technology, Regensburg, Germany, dated Jul. 4, 2017 (5 pages).

Hansen, John H.L., et al., entitled "Text-Directed Speech Enhancement Employing Phone Class Parsing And Feature Map Constrained Vector Quantization" Speech Communication at Robust Speech Processing Laboratory, Duke University, Durham, NC, dated Dec. 10, 1996, p. 169-p. 189 (21 pages).

Luc Le Magoarou, et al., entitled "Text-Informed Audio Source Separation Using Nonnegative Matrix Partial Co-Factorization", 2013 IEEE International Workshop on Machine Learning for Signal Processing at Southampton, UK dated Sep. 22, 2013 (6 pages).

* cited by examiner

DIALOGUE ENHANCEMENT BASED ON SYNTHESIZED SPEECH

CROSS REFERENCE TO RELATED APPLICATIONS

This application claims priority to U.S. Provisional Application No. 62/676,368, filed May 25, 2018 and European Patent Application No. 18174310.5, filed May 25, 2018, each of which is incorporated by reference in their entirety herein.

FIELD OF THE INVENTION

The present invention generally relates to dialogue enhancement in audio signals.

BACKGROUND OF THE INVENTION

Dialogue enhancement is an important signal processing feature for the hearing impaired, and applied in e.g. hearing aids, television sets, etc. Traditionally, it has been done by applying a fixed frequency response curve that emphasizes (amplifies) all content in the frequency range where dialogue is typically present. This type of "single ended" dialogue enhancement may be improved by some type of adaptive approach based on detection and analysis of the audio signal. In a simple case, the application of the fixed frequency response curve can be made conditional on specific criteria (sometimes referred to as "gated" dialogue enhancement). In more complicated implementations, also the frequency response curve is adaptive, and based on the input audio signal. However, gated dialog enhancers are difficult to implement in that they typically require a classifier or speech activity detector. Methods based upon time frequency analysis are difficult to design and are prone to misdetection of speech.

Another approach for dialogue enhancement is based on metadata included in the audio stream, i.e. information from the encoder sider specifying the dialogue content, thereby facilitating enhancement. The metadata can include "flags" indicting when to activate dialogue enhancement, and also an indication of frequency content thereby allowing adjustment of the frequency response curve. In other examples, the metadata can be parameters allowing a parametric reconstruction of the dialogue content, which dialogue content may then be amplified as desired. This approach, to include dialogue metadata in the audio stream, generally has high performance. However, it is restricted to dual ended systems, i.e. where the audio stream is preprocessed on the transmitter side, e.g. in an encoder.

There is a need for even further improvement of dialogue enhancement technology.

GENERAL DISCLOSURE OF THE INVENTION

It is a general objective of the present invention to provide improved performance of dialogue enhancement, in particular single-ended dialogue enhancement in the absence of explicit metadata.

According to a first aspect of the present invention, this and other objectives are achieved by a method for dialogue enhancement of an audio signal, comprising receiving an audio stream including said audio signal and a text content associated with dialogue occurring in the audio signal, generating parameterized synthesized speech from said text content, and applying dialogue enhancement to the audio signal based on the parameterized synthesized speech.

According to a second aspect, this and other aspects are achieved by a system for dialogue enhancement of an audio signal, based on a text content associated with dialogue occurring in the audio signal, the system comprising a speech synthesizer for generating a parameterized synthesized speech from the text content, and a dialogue enhancement module for applying dialogue enhancement to the audio signal based on the parameterized synthesized speech.

The invention is based on the notion that text captions, subtitles, or other forms of text content included in an audio stream, and being related to dialogue occurring in the audio signal, can be used to significantly improve dialogue enhancement on the playback side. More specifically, the text may be used to generate parameterized synthesized speech, which may be used to enhance (amplify) dialogue content.

The invention may be advantageous in a single ended system (e.g. broadcast or downloaded media) such as in a TV or set-top-box. In a single ended system, the audio stream is typically not specifically preprocessed for dialogue enhancement, and the invention may significantly improve dialogue enhancement on the receiver side.

As indicated above, the invention is particularly useful in single-ended dialogue enhancement, i.e. where the transmitted audio stream has not been preprocessed to facilitate dialogue enhancement. However, the invention may also be advantageous in a dual-ended system, in which case the step of generating parameterized synthesized speech can be performed on the sender side. For example, the invention could be used to extract a dialogue component from an existing audio mix, for situations when the dialogue stream is transmitted as an independent buffer. Or, the invention could contribute to computation of dialogue coefficients in applications where dialogue is represented with coefficient weights (metadata) transmitted to the receiver (decoder) side.

In order to align the frequency content of the synthesized speech with the frequency content of the audio signal, it may be advantageous to compare the parameterized synthesized speech with the audio signal to provide an error signal, and to apply feedback control of the parameterized synthesized speech based on the error signal.

There are several ways of using the synthesized speech in the dialogue enhancement.

In one embodiment, the dialogue enhancement includes application of a fixed frequency response curve, and the application of the fixed frequency response curve is conditional on the parameterized synthesized speech. With this approach, the frequency response curve is only applied when it can be established that the audio signal includes dialogue. As a consequence, the quality of the dialogue enhancement is improved.

In another embodiment, the synthesized speech is used as a reference for an adaptive system (for example a minimum mean squared error (MMSE) tracking) to extract an estimate of the dialogue from the original audio signal. Dialogue enhancement is then performed by amplifying the extracted dialogue and mixing it back into the (time aligned) original audio signal. This corresponds in principle to the dialogue enhancement performed using parameterized dialogue encoded in the audio stream, but made possible without metadata.

In yet another embodiment, time/frequency gains are applied to the audio signal based on the parameterized synthesized speech. The gains will vary with the content of the speech across time and frequency. This corresponds in principle to an application of an adaptive frequency response curve.

In some embodiments, the text content includes annotations identifying a specific speaker, and the generation of synthesized speech may then be aligned with a model of the identified speaker.

The text content may further include abbreviations of words present in the dialogue occurring in the audio signal, in which case the method may further include extending the abbreviations into full words which are likely to correspond to the words present in the dialogue.

A further aspect of the present invention related to a computer program product comprising computer program code portions which, when executed on a computer processor, enable the computer processor to perform the method of the first aspect of the invention.

BRIEF DESCRIPTION OF THE DRAWINGS

The present invention will be described in more detail with reference to the appended drawings, showing currently preferred embodiments of the invention.

DETAILED DESCRIPTION OF CURRENTLY PREFERRED EMBODIMENTS

Systems and methods disclosed in the following may be implemented as software, firmware, hardware or a combination thereof. In a hardware implementation, the division of tasks referred to as "stages" in the below description does not necessarily correspond to the division into physical units; to the contrary, one physical component may have multiple functionalities, and one task may be carried out by several physical components in cooperation. Certain components or all components may be implemented as software executed by a digital signal processor or microprocessor, or be implemented as hardware or as an application-specific integrated circuit. Such software may be distributed on computer readable media, which may comprise computer storage media (or non-transitory media) and communication media (or transitory media). As is well known to a person skilled in the art, the term computer storage media includes both volatile and non-volatile, removable and non-removable media implemented in any method or technology for storage of information such as computer readable instructions, data structures, program modules or other data. Computer storage media includes, but is not limited to, RAM, ROM, EEPROM, flash memory or other memory technology, CD-ROM, digital versatile disks (DVD) or other optical disk storage, magnetic cassettes, magnetic tape, magnetic disk storage or other magnetic storage devices, or any other medium which can be used to store the desired information and which can be accessed by a computer. Further, it is well known to the skilled person that communication media typically embodies computer readable instructions, data structures, program modules or other data in a modulated data signal such as a carrier wave or other transport mechanism and includes any information delivery media.

Figure 1:
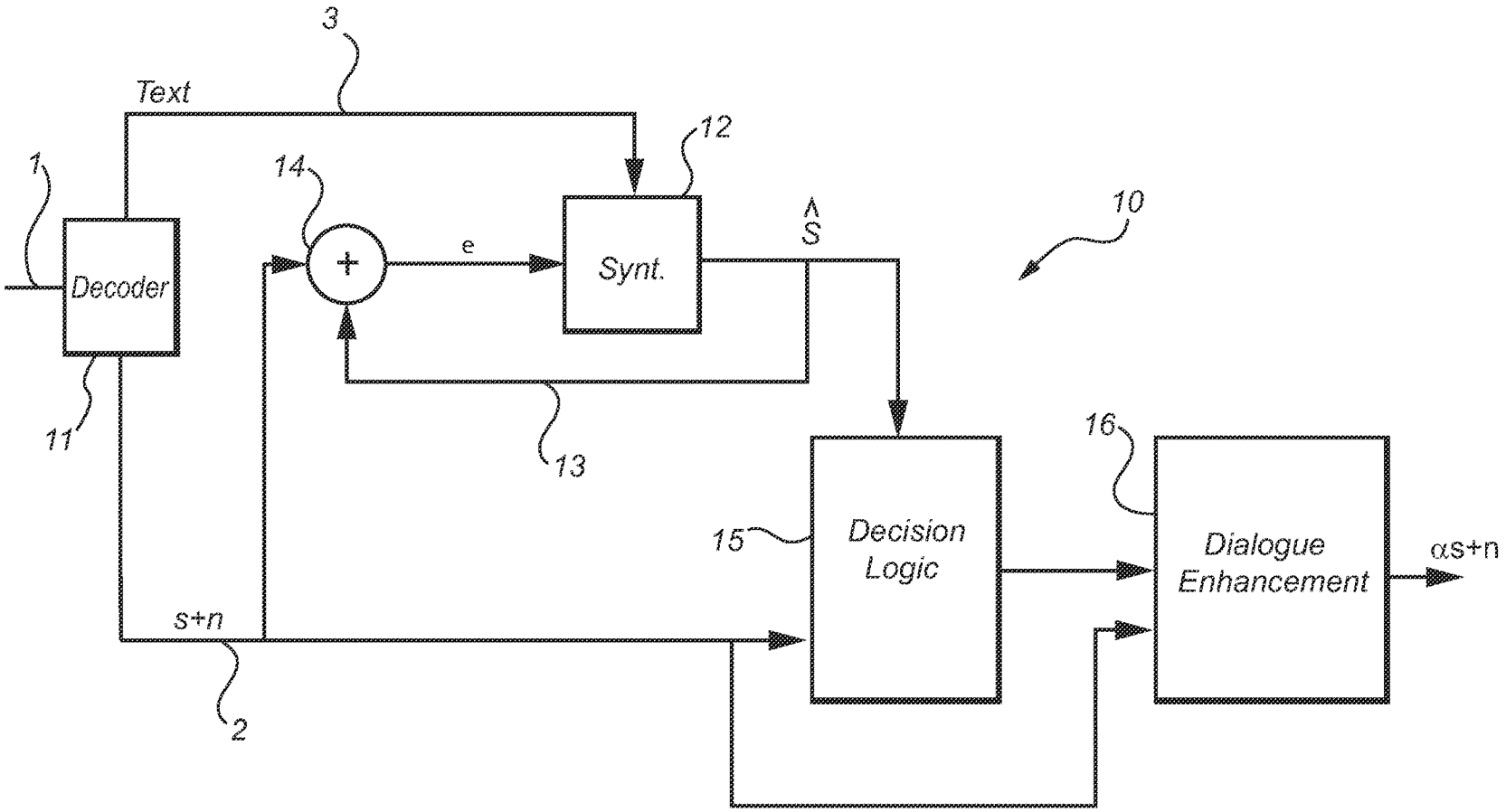
FIG. 1 shows a block diagram of a dialogue enhancement system according to a first embodiment of the invention.

FIG. 1 shows a first example of a dialogue enhancement system 10 using text captions 3 included in an audio stream 1 for dialogue enhancement of an audio signal 2. The audio signal can be described as a dialogue component s, mixed with a noise or background component n. The purpose of the dialogue enhancement system 10 is to increase the s/n-ratio.

The system is connected to receive an audio stream including the audio signal 2 and the text content 3. If the dialogue enhancement system 10 receives the audio signal 2 and text content 3 as a combined audio stream 1, the system may include a decoder 11 for separating the audio signal 2 from the text 3. Alternatively, the system receives the text 3 separately from the audio signal 2.

The system further includes a speech synthesizer 12, for generating a parameterized synthesized speech s. The synthesizer may be a parametric vocoder or a machine learning algorithm based upon a corpus of training data. Machine learning algorithms may have an advantage with respect to taking a specific speaker into consideration.

In some embodiments, the synthesizer 12 may have a feedback loop 13 from the audio signal 2 to a summation point 14 forming an error signal e. The error signal e is fed to synthesizer 12, thereby ensuring that the parameterized synthesized speech s is an estimate of the time and frequency characteristics of the dialogue component s of the audio signal 2.

The parameterized synthesized speech s is fed to a decision logic 15, configured to output a logic signal indicating if dialogue enhancement is to be activated. For example, the logic signal can be set to ON when an energy measure of the synthesized speech exceeds a pre-set threshold. The decision logic may also compare the synchronized speech with the audio signal in order to determine a speech similarity score, and set the logic signal to ON only when the score exceeds a pre-set threshold. Especially in the absence of feedback in the synthesizer, such a similarity score can be used to even better synchronize the logic signal with the audio signal, and thus even further improve the timing of the dialogue enhancement.

The system further comprises a dialogue enhancement module 16, which is connected to receive the logic signal from the decision logic 15, and to activate dialogue enhancement conditionally to this signal. The dialogue enhancement module is here further configured to apply a pre-set frequency response curve amplification of the audio signal.

Figure 2:
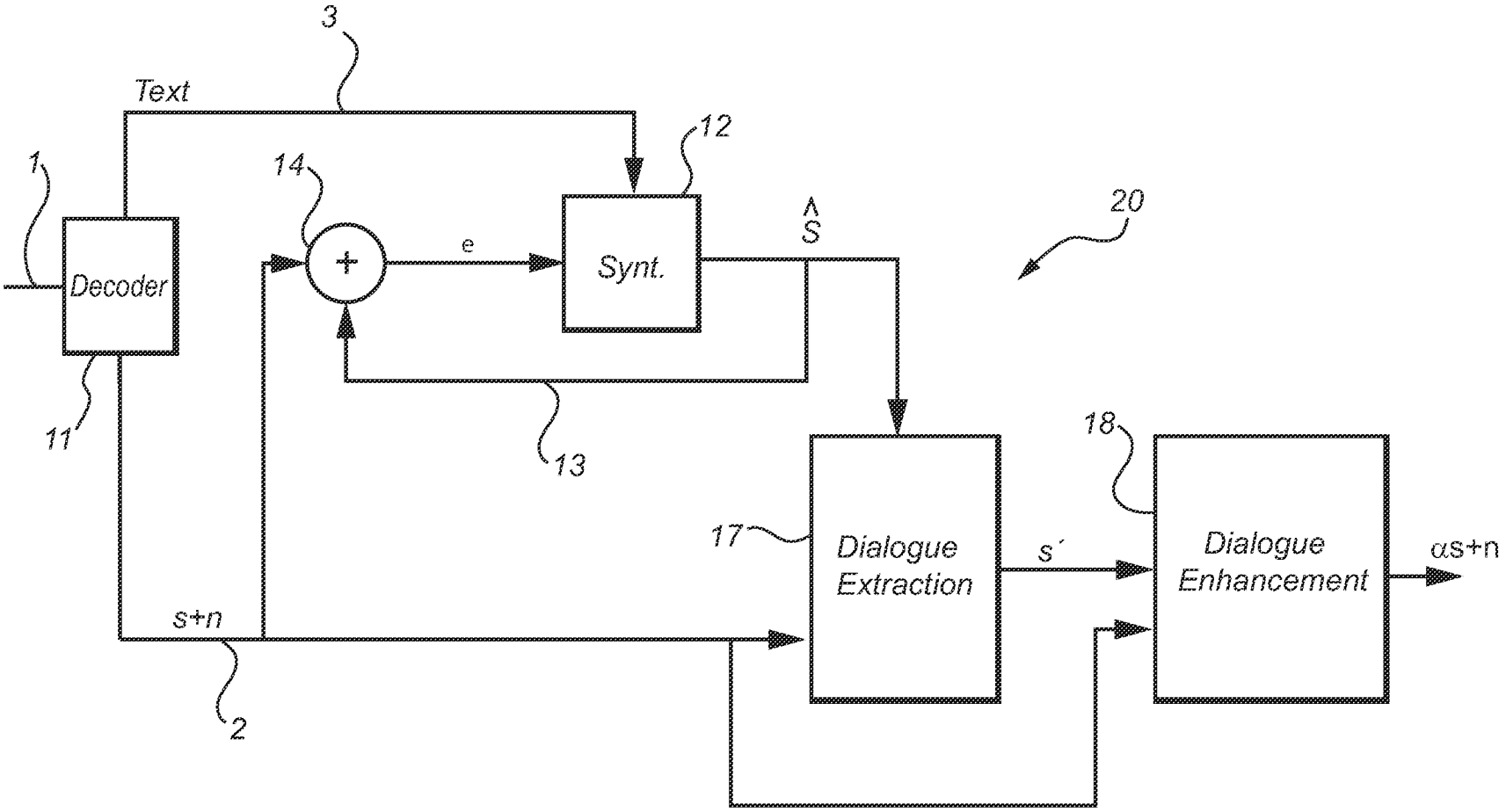
FIG. 2 shows a block diagram of a dialogue enhancement system according to a second embodiment of the invention based on dialogue extraction and gain.

FIG. 2 shows another embodiment of a dialogue enhancement system 20 according to the invention. In the embodiment in FIG. 2, signals 1-3 and blocks 11-14 are identical to those in FIG. 1, and will not be further described.

In FIG. 2, the parameterized synthesized speech $\hat{s}$ is fed to a dialogue extraction filter 17, which is configured to extract dialogue content from the audio signal by comparing the audio signal with the parameterized synthesized speech $\hat{s}$. The result of the comparison is an estimation s' of the dialogue component s of the audio signal which may be used for dialogue enhancement.

The comparison may be based on a minimum mean square error (MMSE) approach, where the coefficients of the filter 17 are selected to minimize the error.

Words or even phonemes of the synthesized dialogue can be compared individually to a smaller window of the audio signal, for example in the frequency domain.

Finally, the system includes a dialogue enhancement module 16, which is configured to apply a gain to the extracted dialogue s and mixes this into the audio signal. The result is a dialogue enhanced signal $\alpha s+n$, where $\alpha>1$.

Figure 3:
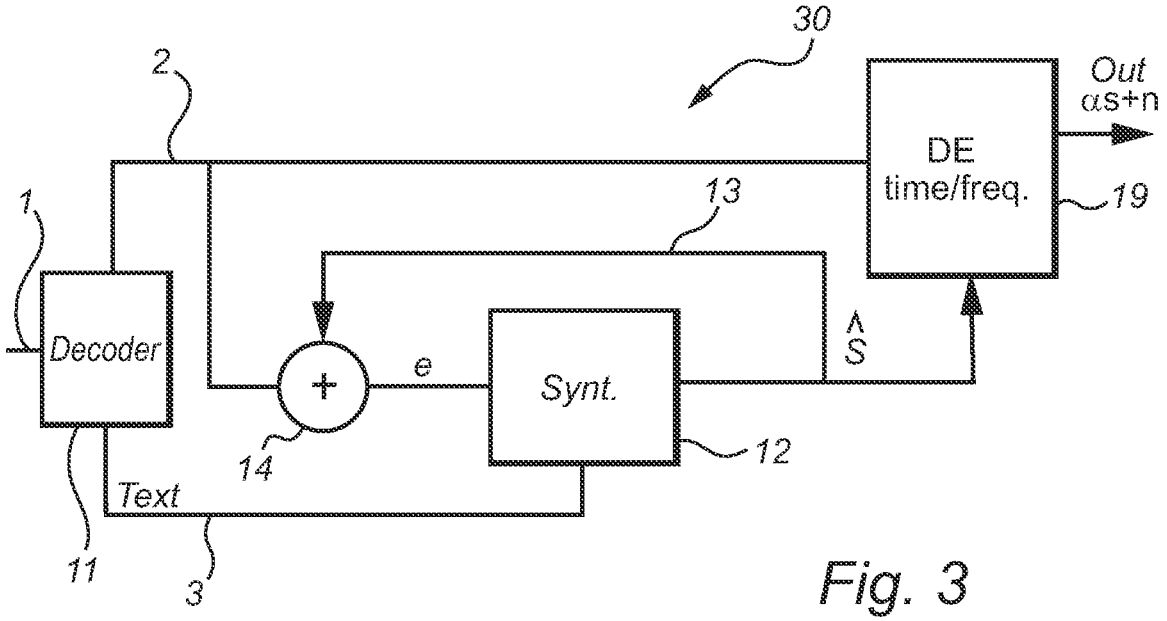
FIG. 3 shows a block diagram of a dialogue enhancement system according to a third embodiment of the invention based on time/frequency enhancement.

FIG. 3 shows another embodiment of a dialogue enhancement system 30 according to the invention. In the embodiment in FIG. 2, signals 1-3 and blocks 11-14 are identical to those in FIGS. 1 and 2, and will not be further described.

In the system 30 in FIG. 3, the feedback loop 13 is required and serves to minimize the error e between the dialogue to be enhanced in the audio signal and the parameterized synthesized speech ŝ generated by the synthesizer 12. The feedback loop 13 thus ensures that the parameterized synthesized dialogue ŝ is an estimate of the time and frequency characteristics of the dialogue component s in the audio signal 2.

In some embodiments, the feedback loop 13 will allow the synthesizer to iterate over parameters that adjust the synthesized speech ŝ. The feedback may adjust features such as (but not limited to): the cadence, pitch, time alignment, amplitude of the synthesized speech in relation to the dialogue in the audio signal.

In the system in FIG. 3, the parameterized dialogue is fed directly into a dialog enhancement module 19, to control the application of time/frequency gains on the audio signal. By applying varying time/frequency gains to the audio signal which match the dialogue content in the audio signal, the speech-to-noise (s/n) ratio is amplified, and the output is a dialogue enhanced signal $\alpha s+n$, where $\alpha>1$. The result is an adaptive dialogue enhancement.

Figure 4:
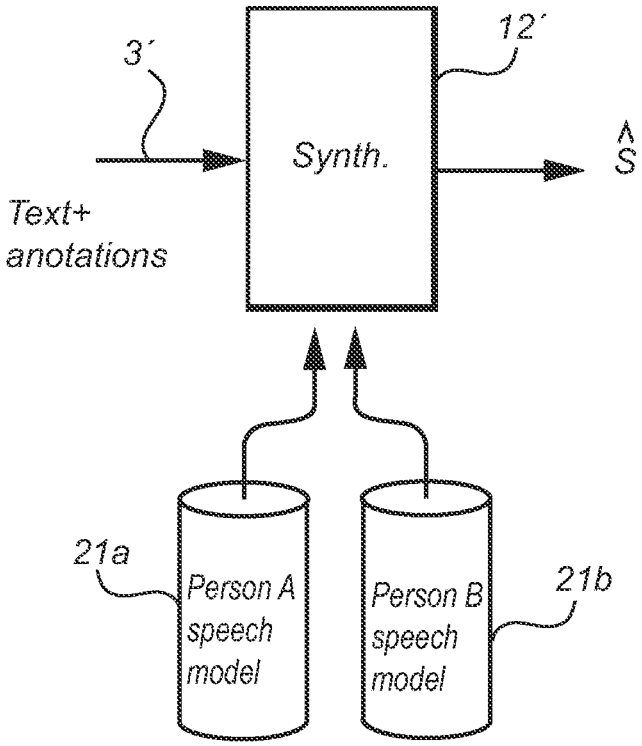
FIG. 4 shows an embodiment of the invention using annotations.

FIG. 4 shows a further example of a dialogue synthesizer 12', configured to apply a personalized speech model 21*a*, 21*b* to increase the accuracy of the synthesized speech ŝ. The synthesizer is further adapted to extract annotations within the text content 3', which annotations indicate a specific speaker. The synthesizer 32 then uses such annotations to select the correct speech model 21*a*, 21*b*.

For example, when receiving the following annotation+ text:

Fred: Hello Mary. What are you planning to have for lunch today?

a first speech model 21*a*, associated with the speaker Fred, will be applied.

Further, when receiving the following reply:

Mary: I am planning on having a tuna salad sandwich

A second speech model 21*b*, associated with the speaker Mary, will be applied.

If there is no pre-stored speech model for a specific annotation, a default model may be applied.

Figure 5:
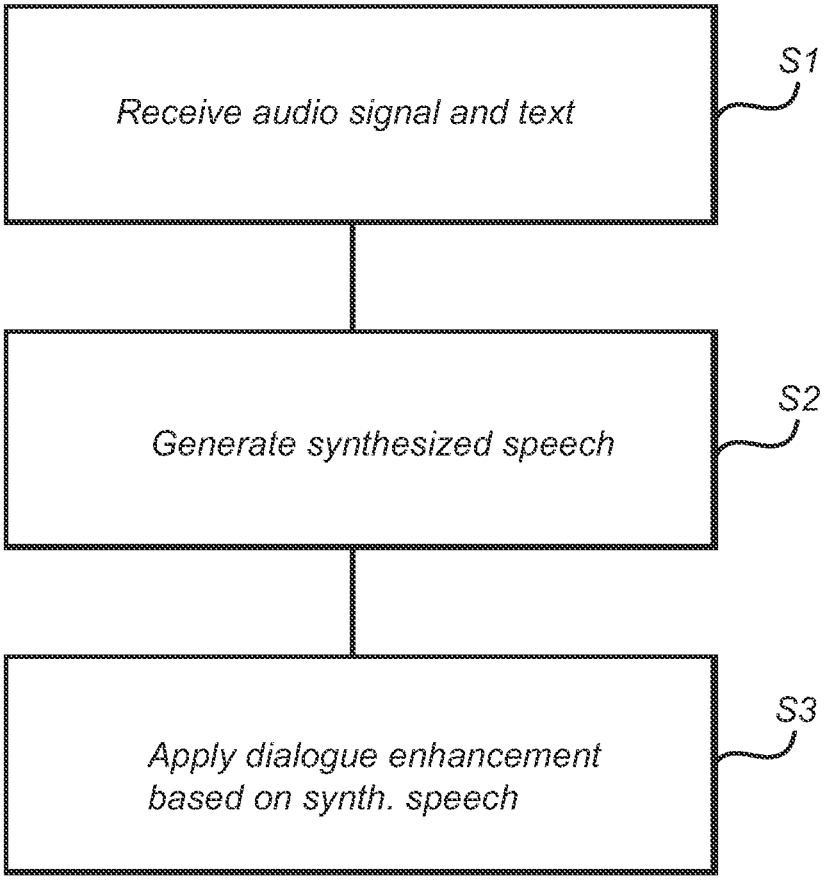
FIG. 5 is a flow chart of dialogue enhancement according to an embodiment of the invention.

With reference to FIG. 5, a method according to an embodiment of the invention includes in step S1 receiving an audio signal 2 which includes a dialogue content s and noise/background n and receiving text content 3 associated with the dialogue content.

In step S2, the speech synthesizer 12 provides a parameterized synthesized dialogue ŝ corresponding to the text 3, and optionally applies a feedback control based on the audio signal to ensure that the frequency content of the parameterized synthesized dialogue s matches that of the audio signal.

In step S3, the parameterized synthesized dialogue ŝ is used to control dialogue enhancement.

In a system according to the embodiment in FIG. 1, the speech synthesis in step S2 is used only to make a qualified assessment of when there is dialogue present in the audio signal, and in that case activate a (static) dialogue enhancement.

In a system according to the embodiment in FIG. 2, the speech synthesis in step S2 is used to extract an estimated dialogue from the audio signal by comparison to the parameterized synthesized dialogue s in the dialogue extraction filter 17, and then, in the dialogue enhancement module 18, applying a gain to this estimated dialogue and mixing it with the original audio signal.

Finally, in a system according to FIG. 3, the parameterized synthesized dialogue ŝ is used directly by a dialogue enhancement module 19 to apply adaptive time/frequency gains to the audio signal.

The person skilled in the art realizes that the present invention by no means is limited to the preferred embodiments described above. On the contrary, many modifications and variations are possible within the scope of the appended claims. In particular, there are other ways to use parameterized synchronized speech based on text captions to improve dialogue enhancement of audio associated with this text.

Further, a dialogue enhancement system according to the invention could be configured to detect abbreviations in the text content, and be configured to extend such abbreviations into full words which are likely to correspond to the words present in the dialogue.

Furthermore, while some embodiments described herein include some but not other features included in other embodiments, combinations of features of different embodiments are meant to be within the scope of the invention, and form different embodiments, as would be understood by those skilled in the art. For example, in the following claims, any of the claimed embodiments can be used in any combination.

In the following, a set of exemplary embodiments (EE's) will be presented.

EE1. A method for dialogue enhancement of an audio signal (2), comprising:

receiving (step S1) said audio signal (2) and a text content (3) associated with dialogue occurring in the audio signal, generating (step S2) parameterized synthesized speech (s) from said text content, and applying (step S3) dialogue enhancement to said audio signal based on said parameterized synthesized speech (s).

EE2. The method according to EE1, further comprising:

comparing the parameterized synthesized speech with the audio signal to provide an error signal, and applying feedback control of the parameterized synthesized speech based on the error signal, in order to align the frequency content of the synthesized speech with the frequency content of the audio signal.

EE3. The method according to EE1 or EE2, wherein the step of applying dialogue enhancement is conditional on a comparison between the audio signal and the parameterized synthesized speech (s).

EE4. The method according to EE3, wherein the applying dialogue enhancement includes application of a fixed frequency response curve.

EE5. The method according to one of EE1-EE3, further comprising:

applying a time/frequency gain to the audio signal based on the parameterized synthesized speech.

EE6. The method according to one of EE1-EE3, further comprising:

applying a dialogue extraction filter to the audio signal to obtain an estimated dialogue, wherein said dialogue extraction filter is determined by comparing the extracted dialogue component with said parameterized synthesized speech and minimizing an error, applying a gain to the estimated dialogue to obtain an amplified dialogue component, and mixing the amplified dialogue component with the audio signal.

EE7. The method according to EE6, wherein the error is a minimum means square error (MMSE).

EE8. The method according to any one of the preceding EEs, wherein the text content includes annotations identifying a specific speaker, and wherein generation of the synthesized speech is aligned with a model of the identified speaker.

EE9. The method according to any one of the preceding EEs, wherein said text content includes abbreviations of words present in the dialogue occurring in the audio signal, the method further including:

extending the abbreviations into full words which are likely to correspond to the words present in the dialogue.

EE10. The method according to any one of the preceding EEs, wherein the step of generating parameterized synthesized speech is performed on a sender side of a dual-ended system.

EE11. The method according to EE10, further comprising extracting a dialogue component from an existing audio mix, and including said dialogue component in a transmitted audio bit stream.

EE12. The method according to EE10, further comprising computing dialogue coefficients representing dialogue, and including said dialogue coefficients in a transmitted audio bit stream.

EE13. A system for dialogue enhancement of an audio signal (2), based on a text content (3) associated with dialogue occurring in the audio signal, the system comprising:

a speech synthesizer (12, 22) for generating a parameterized synthesized 30 speech (s) from said text content, and a dialogue enhancement module (16, 26) for applying dialogue enhancement to said audio signal based on said parameterized synthesized speech (s).

EE14. The system according to EE13, further comprising:

a feedback loop (13, 23) for feedback of the parameterized synthesized speech, and a summation point (14, 24) for comparing the parameterized synthesized speech with the audio signal to provide an error signal, wherein the synthesizer is configured to apply feedback control of the parameterized synthesized speech based on the error signal, in order to align the frequency content of the synthesized speech with the frequency content of the audio signal.

EE15. The system according to EE13 or EE14, wherein the dialogue enhancement module is configured to apply dialogue enhancement conditionally on the parameterized synthesized speech (s).

EE16. The system according to EE15, wherein the dialogue enhancement module is configured to apply a fixed frequency response curve.

EEEE17. The system according to one of EE13-EE15, wherein the dialogue enhancement module (26) is configured to apply a time/frequency gain to the audio signal based on the parameterized synthesized speech.

EE18. The system according to one of EE13-EE15, further comprising:

a dialogue extraction filter (17) for obtaining an estimated dialogue, wherein said dialogue extraction filter is determined by comparing the extracted dialogue component with said parameterized synthesized speech and minimizing an error, wherein the dialogue enhancement module (16) is configured to apply a gain to the estimated dialogue to obtain an amplified dialogue component, and mix the amplified dialogue component with the audio signal.

EE19. A single ended receiver, comprising:

a receiving module for receiving a bit stream including an audio signal (2) and a text content (3) associated with dialogue occurring in the audio signal;

a speech synthesizer (12, 22) for generating a parameterized synthesized speech (s) from said text content; and a dialogue enhancement module (16, 26) for applying dialogue enhancement to said audio signal based on said parameterized synthesized speech (s).

EE20. A computer program product comprising computer program code portions which, when executed on a computer processor, enable the computer processor to perform the steps of the method according to one of EE1-EE12.

EE21. A non-transitory computer readable medium storing thereon a computer program product according to EE20.

What is claimed is:

1. A method for dialogue enhancement of an audio signal, comprising:

receiving (step S1), by a microprocessor, said audio signal and a text content associated with dialogue occurring in the audio signal, generating (step S2), by the microprocessor, parameterized synthesized speech ($\hat{S}$) from said text content, and applying (step S3), by the microprocessor, dialogue enhancement to said audio signal based on said parameterized synthesized speech ($\hat{S}$)

wherein the text content includes annotations identifying a specific speaker, and wherein generation of the synthesized speech is aligned with a model of the identified speaker, and wherein applying the dialogue enhancement includes comparing an energy of the parameterized synthesized speech ($\hat{S}$) to a threshold, wherein the dialogue enhancement is applied when the energy exceeds the threshold.

2. The method according to claim 1, further comprising:

comparing the parameterized synthesized speech with the audio signal to provide an error signal, and applying feedback control of the parameterized synthesized speech based on the error signal, in order to align the frequency content of the synthesized speech with the frequency content of the audio signal.

3. The method according to claim 1, wherein the step of applying dialogue enhancement is conditional on a comparison between the audio signal and the parameterized synthesized speech ($\hat{S}$).

4. The method according to claim 3, wherein the applying dialogue enhancement includes application of a fixed frequency response curve.

5. The method according to claim 1, further comprising:

applying a time/frequency gain to the audio signal based on the parameterized synthesized speech.

6. The method according to claim 1, further comprising:

applying a dialogue extraction filter to the audio signal to obtain an estimated dialogue, wherein said dialogue extraction filter is determined by comparing an extracted dialogue component with said parameterized synthesized speech and minimizing an error, applying a gain to the estimated dialogue to obtain an amplified dialogue component, and mixing the amplified dialogue component with the audio signal.

7. The method according to claim 6, wherein the error is a minimum means square error (MMSE).

8. The method according to claim 1, wherein said text content includes abbreviations of words present in the dialogue occurring in the audio signal, the method further including:

extending the abbreviations into full words which are likely to correspond to the words present in the dialogue.

9. The method according to claim 1, wherein the step of generating parameterized synthesized speech is performed on a sender side of a dual-ended system.

10. The method according to claim 9, further comprising extracting a dialogue component from an existing audio mix, and including said dialogue component in a transmitted audio bit stream.

11. The method according to claim 9, further comprising computing dialogue coefficients representing dialogue, and including said dialogue coefficients in a transmitted audio bit stream.

12. The method according to claim 1, further comprising:

outputting a dialogue enhanced signal, wherein the dialogue enhanced signal corresponds to the dialogue enhancement having been applied to the audio signal.

13. A non-transitory computer readable medium storing computer program code portions which, when executed on a computer processor, enable the computer processor to perform the steps of the method according to claim 1.

14. A system for dialogue enhancement of an audio signal, based on a text content associated with dialogue occurring in the audio signal, the system comprising:

a speech synthesizer for generating a parameterized synthesized speech ($\hat{s}$) from said text content, and a dialogue enhancement module, implemented by one or more processors, for applying dialogue enhancement to said audio signal based on said parameterized synthesized speech ($\hat{S}$)

wherein the text content includes annotations identifying a specific speaker, and wherein generation of the synthesized speech by the speech synthesizer is aligned with a model of the identified speaker, and wherein applying the dialogue enhancement includes comparing an energy of the parameterized synthesized speech ($\hat{S}$) to a threshold, wherein the dialogue enhancement is applied when the energy exceeds the threshold.

15. The system according to claim 14, further comprising:

a feedback loop for feedback of the parameterized synthesized speech, and a summation point for comparing the parameterized synthesized speech with the audio signal to provide an error signal, wherein the synthesizer is configured to apply feedback control of the parameterized synthesized speech based on the error signal, in order to align the frequency content of the synthesized speech with the frequency content of the audio signal.

16. The system according to claim 15, wherein the dialogue enhancement module is configured to apply dialogue enhancement conditionally on the parameterized synthesized speech ($\hat{S}$).

17. The system according to claim 16, wherein the dialogue enhancement module is configured to apply a fixed frequency response curve.

18. The system according to claim 15, wherein the dialogue enhancement module is configured to apply a time/frequency gain to the audio signal based on the parameterized synthesized speech.

19. The system according to claim 15, further comprising:

a dialogue extraction filter for obtaining an estimated dialogue, wherein said dialogue extraction filter is determined by comparing an extracted dialogue component with said parameterized synthesized speech and minimizing an error, wherein the dialogue enhancement module is configured to apply a gain to the estimated dialogue to obtain an amplified dialogue component, and mix the amplified dialogue component with the audio signal.

20. A single ended receiver, comprising:

a receiving module, implemented by one or more processors, for receiving a bit stream including an audio signal and a text content associated with dialogue occurring in the audio signal;

a speech synthesizer for generating a parameterized synthesized speech ($\hat{S}$) from said text content; and a dialogue enhancement module, implemented by the one or more processors, for applying dialogue enhancement to said audio signal based on said parameterized synthesized speech ($\hat{S}$)

wherein the text content includes annotations identifying a specific speaker, and wherein generation of the synthesized speech by the speech synthesizer is aligned with a model of the identified, and wherein applying the dialogue enhancement includes comparing an energy of the parameterized synthesized speech ($\hat{S}$) to a threshold, wherein the dialogue enhancement is applied when the energy exceeds the threshold.

* * * * *